US006647878B2

(12) United States Patent
Blau et al.

(10) Patent No.: US 6,647,878 B2
(45) Date of Patent: Nov. 18, 2003

(54) APPARATUS FOR APPLYING PRINTED MATTER TO WEBS OF WRAPPING MATERIAL FOR SMOKERS' PRODUCTS

(75) Inventors: Mathias Blau, Hamburg (DE); Wolfgang Steiniger, Geesthacht (DE); Hans-Hugo Severin, Hamburg (DE)

(73) Assignee: Hauni Mashinenbau AG, Hamburg (DE)

( * ) Notice: Subject to any disclaimer, the term of this patent is extended or adjusted under 35 U.S.C. 154(b) by 256 days.

(21) Appl. No.: 09/775,637

(22) Filed: Feb. 5, 2001

(65) Prior Publication Data

US 2001/0013289 A1 Aug. 16, 2001

(30) Foreign Application Priority Data

Feb. 11, 2000 (DE) ..... 100 06 124

(51) Int. Cl.[7] ..... B41F 31/00
(52) U.S. Cl. ..... 101/352.03; 101/216; 101/247
(58) Field of Search ..... 101/349.1, 352.01, 101/352.02, 352.03, 352.06, 352.07, 352.09, 247, 216, 219, 350.1, 350.3, 350.5, 351.1, 351.4

(56) References Cited

U.S. PATENT DOCUMENTS

| | | | | |
|---|---|---|---|---|
| 3,167,010 A | | 1/1965 | Worthington et al. | |
| 3,563,173 A | * | 2/1971 | Harless | 101/350.1 |
| 3,814,014 A | * | 6/1974 | Dahlgren | 101/352.09 |
| 3,901,150 A | * | 8/1975 | Kirby | 101/351.1 |
| 4,084,501 A | * | 4/1978 | Kerwin et al. | 101/219 |
| 4,127,067 A | * | 11/1978 | Dahlgren | 101/350.5 |
| 4,240,348 A | | 12/1980 | Sato | |
| 4,373,442 A | * | 2/1983 | Dahlgren et al. | 101/351.4 |
| 4,429,631 A | * | 2/1984 | Commers | 101/350.3 |
| 4,538,515 A | * | 9/1985 | Tymkewicz et al. | 101/216 |
| 4,986,285 A | | 1/1991 | Radzio et al. | |
| 5,085,514 A | * | 2/1992 | Mallik | 359/2 |
| 5,135,008 A | | 8/1992 | Oesterling et al. | |

FOREIGN PATENT DOCUMENTS

| | | |
|---|---|---|
| DE | 1 950 236 | 11/1966 |
| DE | 72 20 054 | 5/1972 |
| DE | 30 14 904 A1 | 11/1981 |
| DE | 30 14 904 | 11/1981 |
| DE | 202 241 | 6/1982 |
| DE | 38 05 143 C1 | 2/1988 |
| DE | 83 13 742 | 12/1989 |
| DE | 197 30 681 | 4/1998 |
| DE | 197 30 681 A1 | 4/1998 |
| DE | 196 48 567 A1 | 5/1998 |
| DE | 199 19 733 A1 | 11/1999 |
| DE | 199 19 733 | 11/1999 |

* cited by examiner

*Primary Examiner*—Eugene H. Eickholt
(74) *Attorney, Agent, or Firm*—Venable, LLP; Robert Kinberg; Chad C. Anderson

(57) ABSTRACT

An apparatus for applying printed matter to the running web of cigarette paper or the like in a machine for making rod-shaped smokers' products employs a roller train which transfers printing ink from one or more sources to a rotary carrier of one or more stamps serving to apply trademarks, manufacturer's names and/or other printed matter to longitudinally spaced apart portions of the running web. At least one roller of the roller train has a resilient cylindrical outer layer which contacts the peripheral surface of at least one other roller of the train and surrounds an adjustable rotary eccentric which biases the cylindrical outer layer against the at least one other roller with a force determined by a prestressed coil spring. The eccentric is oscillatable axially against the opposition of a second spring, such as a diaphragm spring.

18 Claims, 3 Drawing Sheets

47
46
53
23
43
43a
44
46
48
49
51
21
52

APPARATUS FOR APPLYING PRINTED MATTER TO WEBS OF WRAPPING MATERIAL FOR SMOKERS' PRODUCTS

CROSS-REFERENCE TO RELATED CASES

The present application claims the priority of the commonly owned copending German patent application Serial No. 100 06 124.9 filed Feb. 11, 2000. The disclosure of the above-referenced German patent application, as well as that of each U.S. and foreign patent and patent application identified in the specification of the present application, is incorporated herein by reference.

BACKGROUND OF THE INVENTION

The invention relates to improvements in machines and/or apparatus for applying printed matter to running webs of paper or the like, for example, for applying printed matter to running webs in machines or production lines for making rod-shaped articles of the type wherein a tubular (cylindrical) envelope or wrapper surrounds one or more fillers, such as rod-shaped fillers consisting of or containing tobacco and/or filter material for tobacco smoke. Examples of articles or products or commodities which can be turned out by machines or production lines to which the present invention pertains or can pertain are plain or filter cigarettes, cigars, cigarillos, other types of smokers' products, catamenial tampons and many others.

It is customary to provide the tubular wrappers of cigarettes and other rod-shaped products of the tobacco processing industry with printed information denoting the trademark(s) and/or the name and/or other data pertaining to the manufacturer. The information can be applied in such away that it extends longitudinally or circumferentially of the wrapper of a finished product or in part longitudinally and in part circumferentially. The information can be unicolored or multicolored and can include one or more words, logograms, pictures or the like. The application of such printed information in a readily discernible form, at the customary location and/or in proper color(s) or combinations of colors is desirable to the consumers as well as to the manufacturer.

The application of printed matter to the webs or strips which are to be converted into tubular envelopes or wrappers of smokers' products, catamenial tampons and many other rod-shaped commodities normally involves the utilization of an imprinting apparatus which receives printing ink from one or more sources and includes a combination (hereinafter called train) of cooperating rollers which process the ink and apply it to the part or parts (such as one or more stamps or analogous applicators) which actually contacts or contact predetermined portions of a running web of cigarette paper, imitation cork, so-called tipping paper and/or other strip-shaped materials which are utilized to confine rod-like fillers made, for example, of natural, reconstituted or substitute tobacco and/or filter material for tobacco smoke. A preferred location for an imprinting apparatus which can be employed to apply printed matter to a running web or strip of cigarette paper is disclosed, for example, in commonly owned U.S. Pat. No. 4,986,285 granted Jan. 22, 1991 to Radzio et al. for "METHOD AND APPARATUS FOR ASCERTAINING THE DENSITY OF WRAPPED TOBACCO FILLERS AND THE LIKE".

A drawback of presently known imprinting apparatus which are utilized in cigarette making and like machines is that they are not capable of invariably ensuring acceptable, satisfactory or optimum application of printed matter under all circumstances which can be expected to arise in cigarette making, filter rod making, filter cigarette making and analogous machines wherein rod-shaped fillers are confined in tubular envelopes or wrappers bearing printed matter which must appear at a predetermined locus of each finished product, which must be plainly legible and/or otherwise discernible, which is applied in one or more colors and the application of which does not necessitate a slowdown of the machine or production line in which the application of printed matter takes place.

OBJECTS OF THE INVENTION

An object of the present invention is to provide a novel and improved apparatus which can apply printed matter to a running web or strip of paper or the like in a manner which is superior to that achievable by resorting to presently known printing or imprinting apparatus.

Another object of the invention is to provide a compact, simple and relatively inexpensive apparatus which can automatically compensate for numerous changes of circumstances under which the application of printed matter takes or should take place.

A further object of the instant invention is to provide a novel and improved method of treating printing ink in the path between one or more sources of printing ink and the locus or loci of application of properly treated or processed ink to a running web or strip of paper or the like.

An additional object of the invention is to provide a novel and improved combination of rotary and other parts in apparatus for applying printed matter to the constituents of rod-shaped smokers' products.

Still another object of the present invention is to provide novel and improved adjustable rotary components for use in an apparatus which serves to apply printed matter to running webs or strips in cigarette making or related machines.

A further object of the invention is to provide a machine which employs one or more imprinting apparatus of the above outlined character.

Another object of the instant invention is to provide an apparatus which is capable of maintaining the consistency of printing ink at an optimum value even when one or more parameters which influence such consistency undergo unexpected and pronounced changes.

An additional object of the invention is to provide an apparatus which can automatically compensate for changes in temperature, for expansion and/or contraction of certain component parts, for changes in the speed or speeds of certain rotary and/or otherwise movable parts, and/or for changes in consistency of printing ink in a reliable, time-saving and optimal manner.

Still another object of the present invention is to provide an imprinting apparatus which can be put to use in many existing cigarette making, filter rod making and analogous machines as a superior substitute for heretofore known and utilized imprinting apparatus.

A further important object of the instant invention is to provide a novel and improved imprinting apparatus which can apply trademarks, manufacturers' names and/or other printed matter to a running web of cigarette paper or the like at the rate required in a modern high-speed cigarette making and/or processing machine or production line which is set up to turn out huge quantities of smokers' products per unit of time.

SUMMARY OF THE INVENTION

Our invention resides in the provision of an apparatus which can be utilized to apply printed matter to a running web of paper (such as cigarette paper or tipping paper) or the like. The improved apparatus comprises a source of printing ink (e.g., one or more nozzles), a mobile web-contacting imprinting member, and a roller train which is arranged to convey printing ink from the source to the imprinting member and includes a plurality of rollers. At least one of the rollers has a resilient peripheral portion (e.g., in the form of a hollow cylinder or sleeve) which contacts at least one other roller of the roller train, and the improved apparatus further comprises means for biasing the resilient peripheral portion of the at least one roller against the at least one other roller.

The biasing means can include means for urging the resilient peripheral portion of the at least one roller against the peripheral surface of the at least one other roller with a variable force.

The roller train can include the at least one roller, the at least one other roller, and a third roller; the resilient peripheral portion of the at least one roller can contact the peripheral surfaces of the at least one roller and of the third roller.

The apparatus can further comprise means (such as a motor-driven shaft) for rotating one of the at least one roller and the at least one other roller, and the resilient peripheral portion of the at least one roller is then in such pronounced frictional contact with the peripheral surface of the at least one other roller that it can transmit torque between the at least one roller and the roller or rollers having peripheral surface(s) in frictional contact with the resilient peripheral surface.

The at least one other roller can be mounted in such a way that it is rotatable about a predetermined axis and that it is also oscillatable in the direction of such axis; this can exert a desirable influence upon the quality of the film of printing ink which is being transported by the peripheral surfaces of the rollers constituting the roller train.

The means for urging the resilient peripheral portion of the at least one roller against the peripheral surface of the at least one other roller can include at least one prestressed resilient element (such as a coil spring) and an eccentric which is interposed between the at least one resilient element and the resilient peripheral portion of the at least one roller. The arrangement can be such that the at least one roller is rotatable about a first axis and the eccentric is turnable (when necessary) about a fixed second axis which is at least substantially parallel to the first axis to thus move the resilient peripheral portion of the at least one roller sideways in a direction at least substantially radially of the at least one other roller. The resilient element is arranged to bias the resilient peripheral portion of the at least one roller in the aforementioned direction, i.e., radially of the at least one other roller. The eccentric can be at least partially confined in the at least one roller; such eccentric can constitute a hollow cylinder.

A first portion of the coil spring can react against a stationary member, and a second portion of such coil spring can at least indirectly bear upon and can tend to turn the eccentric about the aforementioned second axis. The stationary member can include a wall, and the improved apparatus can further comprise a ring which is coaxial with and is affixed to the eccentric; this ring is or can be acted upon by the second portion of the coil spring. Such apparatus can also comprise disengageable rotation preventing means for the stationary member.

The eccentric can be mounted in such a way that it is oscillatable in the direction of its axis, and the improved apparatus then preferably further comprises means for yieldably opposing oscillation of the eccentric; such opposing means can comprise a diaphragm spring which reacts against a retainer (such as a sleeve) and bears upon an end face of the axially oscillatable eccentric.

The source of printing ink can include at least one nozzle which discharges printing ink into a nip of two rollers of the roller train, for example, into a nip defined by the at least one roller and the at least one other roller.

In accordance with one presently preferred embodiment of the invention, the roller train includes four rollers which are rotatable about at least substantially parallel axes and include a driven first roller, a second roller which is driven by the first roller, a third roller which is driven by the second roller, and a fourth roller driven by the third roller. The at least one roller constitutes the second or the fourth roller, and the at least one other roller constitutes one of the first and third rollers. Each of the second and fourth rollers can be provided with a resilient peripheral portion.

If the fourth roller is provided with a resilient peripheral portion, such portion can apply ink to one or more stamps of the mobile web-contacting imprinting member. Such imprinting member can constitute or include a further roller which is rotatable about a predetermined axis (e.g., about an axis which is parallel with the axes of the rollers forming the roller train) and has a peripheral surface provided with at least one stamp which contacts the running web of cigarette paper or the like once during each revolution of the further roller about the predetermined axis.

The roller train can be installed in or at the wrapping mechanism in a cigarette making machine.

The novel features which are considered as characteristic of the invention are set forth in particular in the appended claims. The improved imprinting apparatus itself, however, both as to its construction and the modes of assembling, installing and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
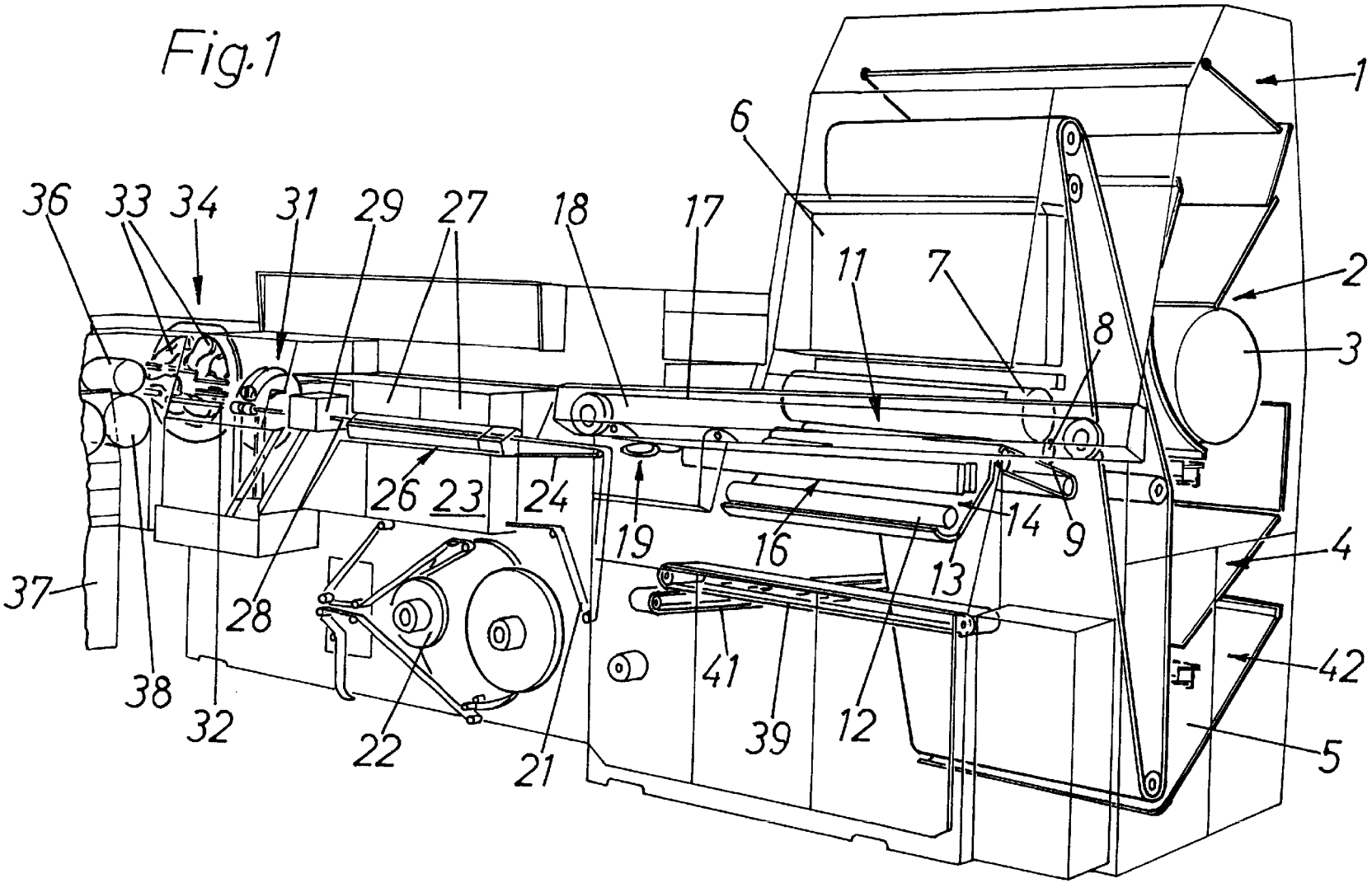
FIG. 1 is a somewhat schematic perspective view of a cigarette making machine and of a portion of a filter cigarette making (tipping) machine, and a diagrammatic view of the housing of an imprinting apparatus which embodies one form of the present invention.

FIG. 1 shows a cigarette rod making machine of the type known as PROTOS (distributed by the assignee of the present application). The machine comprises a gate 1 which is opened at required intervals in order to deliver batches of comminuted tobacco leaves into a first magazine (preliminary distributor) 2. The latter is adjacent a drum-shaped tobacco removing conveyor 3 which delivers particles of tobacco into a second magazine 4 so that this magazine contains a substantially constant supply of fibrous material. The magazine 4 is adjacent the upwardly advancing reach of an elevator in the form of a steep belt or chain conveyor 5 which is provided with spaced-apart pockets for transport of relatively small batches of tobacco particles into the inlet of an upright duct 6. The outlet at the lower end of the duct 6 is adjacent a rotary drum-shaped conveyor 7 which is provided with a peripheral carding serving to advance a continuous and homogeneous layer of tobacco particles into the range of a rapidly driven picker roler 8. The latter expels tobacco particles from the carding of the conveyor 7 and propels them onto the upper reach of a relatively wide belt conveyor 9 whereon the particles accumulate into a relatively wide carpet successive increments of which are advanced into the range of a pneumatic classifying device 11 which defines a curtain of substantially vertical air streams. The inertia of heavier particles (such as fragments of tobacco ribs and the like) suffices to ensure that the trajectories of such particles are not appreciably affected by the curtain of air streams so that the heavier particles are free to enter a suitable collecting receptacle.

The inertia of the remaining (satisfactory) particles is relatively low; therefore, the air curtain deflects such particles (mainly shreds of tobacco leaf laminae) into a funnel 14 which is defined by a driven carded drum 12 and a suitably configurated wall 13. The carding of the drum 12 entrains the lighter particles through the funnel 14 and propels the thus entrained particles into a tobacco channel 16 wherein the particles rise by suction to accumulate at the underside of the lower stretch or reach of an elongated foraminous tobacco stream forming belt conveyor 17. The upper side of the lower reach of the conveyor 17 is adjacent the at least partially open underside of a suction chamber 18 which causes the ascending particles of tobacco to form a growing tobacco stream which is advanced toward and past a suitable trimming or equalizing device 19 serving to remove the surplus from the thus obtained tobacco stream and to convert the trimmed tobacco stream into a filler which is transferred onto the upper side of a continuous web or strip 21 of cigarette paper supplied by a reel 22 mounted at the front side of the frame of the cigarette rod making machine.

The web 21 is advanced in the direction of longitudinal movement of the tobacco filler with the upper reach of an endless belt conveyor 24, and successive increments of the web 21 are caused to pass through a novel and improved imprinting apparatus 23 on their way toward the upper reach of the conveyor 24. The latter advances successive increments of the filler through a wrapping mechanism 26 wherein the web is draped around the filler in such a way that one marginal portion of the web extends substantially tangentially of and away from the filler. The projecting marginal portion is then coated with one or more films of adhesive paste which is supplied by a conventional paster, and the thus coated marginal portion is folded over the other marginal portion to form therewith a seam which extends in parallelism with the axis of the resulting continuous cigarette rod 28. The seam is cooled or heated by the plates of a so-called tandem sealer 27 (depending on the nature of the adhesive which is utilized in the seam) so that the seam is less likely to burst open during travel through a cutoff 31 wherein the rod 28 is subdivided into sections (plain cigarettes) of double unit length. The cutoff 31 is located upstream of a density measuring apparatus 29 the details of which are disclosed in the aforementioned U.S. Pat. No. 4,986,285 to Radzio et al. The signals which are transmitted by the density measuring apparatus 29 are utilized to adjust the position of the trimming device 19 with reference to the underside of the lower reach of the conveyor 17 and to thus alter the density of the filler if the monitored density deviates from an optimum value.

The cutoff 31 in the cigarette making machine of FIG. 1 is designed to subdivide the rod 28 into plain cigarettes 32 of double unit length. Successive cigarettes 32 are engaged by successive orbiting arms 33 of a transfer conveyor 34 and are inserted into or deposited in successive axially parallel peripheral flutes of a drum-shaped conveyor 36 forming part of a filter tipping machine 37, e.g., a machine of the type known as MAX or MAX S (both distributed by the assignee of the present application). A suitable filter tipping machine is disclosed in commonly owned U.S. Pat. No. 5,135,008 granted Aug. 4, 1992 to Oesterling et al. for "METHOD OF AND APPARATUS FOR MAKING FILTER CIGARETTES".

The conveyor 36 delivers successive plain cigarettes 32 into the flutes of a severing drum 38 which cooperates with a suitable circular disc-shaped knife to subdivide each cigarette 32 into a pair of coaxial plain cigarettes of unit length. The plain cigarettes of each pair are moved axially of and away from each other to provide room for a filter mouthpiece of double unit length. Such mouthpiece is secured to the respective pair of plain cigarettes of unit length by a suitable uniting band consisting of so-called tipping paper and serving to convert the plain cigarettes and the mouthpiece into a filter cigarette of double unit length. All this is fully described and illustrated in the aforementioned U.S. Pat. No. 5,135,008 to Oesterling et al.

The cigarette rod making machine of FIG. 1 further comprises two endless belt conveyors 39 and 41 which serve to deliver the surplus from the station for the trimming device 18 to a third magazine 42 which is disposed at a level beneath the second magazine 4 and serves to admit small batches of returned tobacco particles into successive pockets of the conveyor 5. Each such pocket thereupon receives tobacco particles from the magazine 4 before its contents are dumped into the duct 6.

FIG. 1 of the present application is identical with FIG. 1 of the aforementioned commonly owned U.S. Pat. No. 4,986,285 to Radzio et al.

Figure 2:
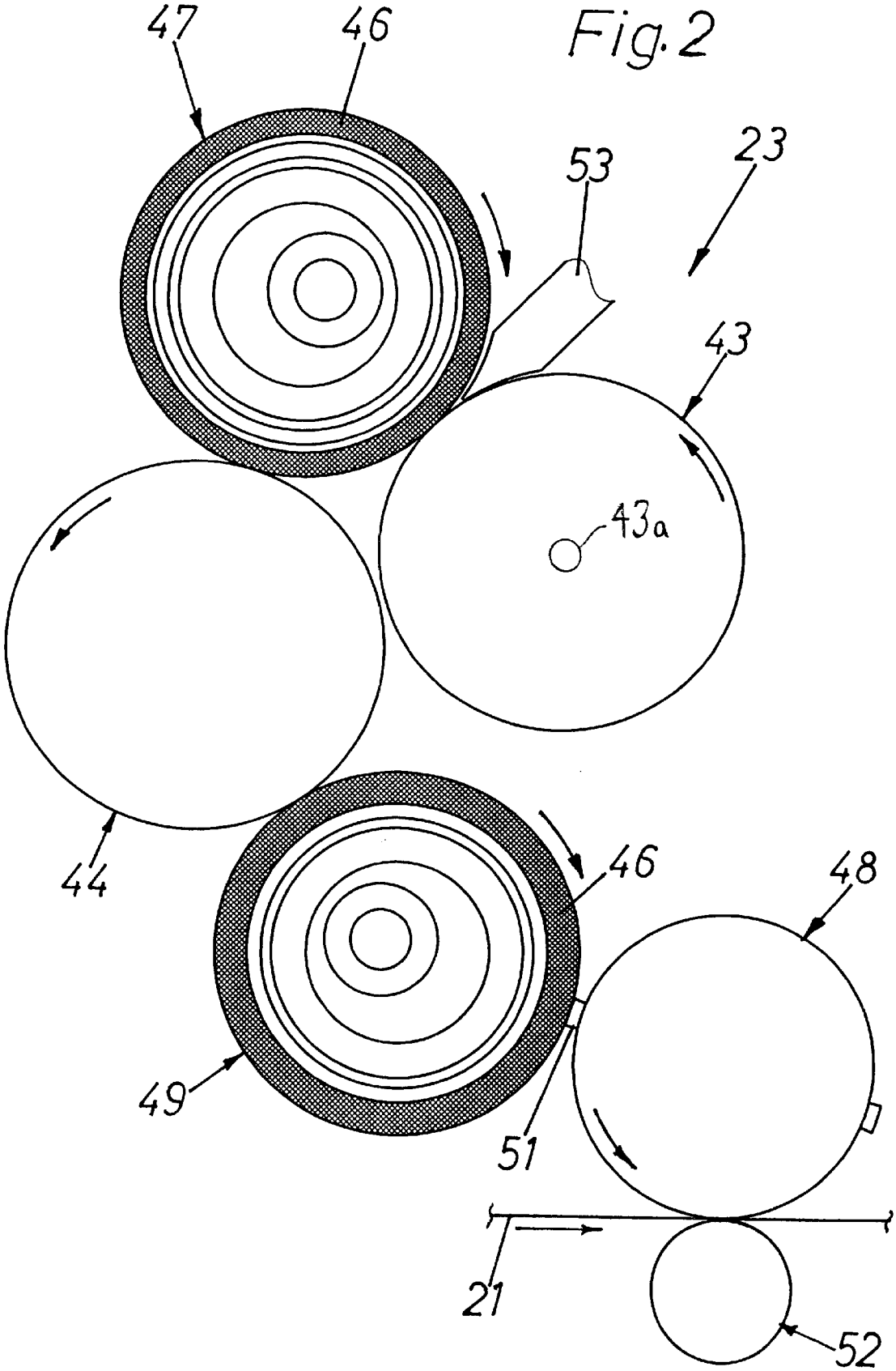
FIG. 2 is a greatly enlarged front elevational view of an imprinting apparatus which embodies one presently preferred form of the invention.
Figure 3:
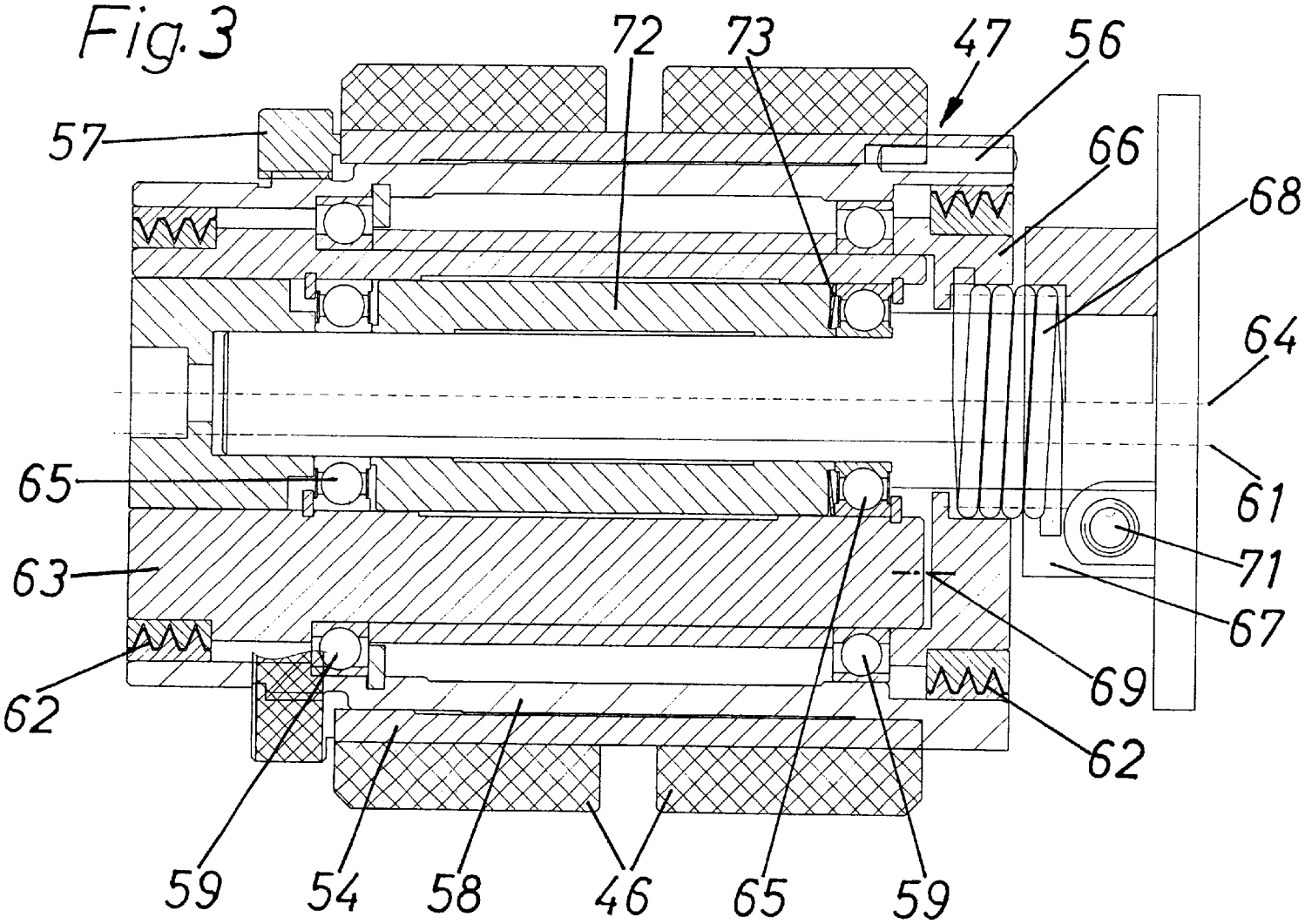
FIG. 3 is a greatly enlarged sectional view of certain constituents of the imprinting apparatus shown in FIG. 2.

The details of the improved imprinting apparatus 23 are shown in FIGS. 2 and 3. This apparatus includes a system or train of rollers including a driven cylindrical first roller (transfer roller) 43, a second cylindrical roller 44 (known as ink distributing roller) which indirectly receives torque from the roller 43 and is oscillatable axially (i.e., at right angles to the plane of FIG. 2), and a third roller 47 which has a resilient cylindrical peripheral portion or outer layer 46 in frictional engagement with the peripheral surfaces of the rollers 43 and 44. The peripheral portion 46 receives torque from the peripheral surface of the roller 43 and transmits torque to the peripheral surface of the roller 44. The peripheral portion or layer 46 can consist of rubber or another suitable elastomeric material.

The roller train of the improved imprinting apparatus 23 further comprises a fourth roller 49 which is or which can be identical with the roller 47 and serves as an ink distributing or transferring member. The resilient peripheral portion 46 of the roller 49 receives torque from the peripheral surface of the roller 44 and transfers films of printing ink to two stamps 51 disposed diametrically opposite each other at the periphery of a rotary web-contacting or imprinting roller 48. The stamps 51 can imprint information (such as the trademark and/or the name of the manufacturer of cigarettes) to longitudinally spaced apart portions of one side of the running cigarette paper web 21 at the apex of an idler counterroller 52. The roller 48 can serve as a carrier for a single stamp 51 or for three or more equidistant stamps.

The directions in which the rollers 43, 44, 47, 48, 49 are rotated when the imprinting apparatus 23 is in actual use (i.e., when the roller 43 is driven by its shaft 43*a* and the roller 48 is also driven to orbit the stamps 51 at the speed of forward movement of the web 21) are indicated by arrows. FIG. 2 further shows a source 53 of printing ink (e.g., a nozzle) which supplies ink into the nip of the rollers 43, 47, and more specifically directly to the peripheral surface of the roller 43. The latter transfers a film of printing ink to the exposed surface of the resilient peripheral portion 46 of the roller 47; the peripheral portion 46, in turn, transfers the film of printing ink to the peripheral surface of the axially oscillating distributing roller 44. The surface of the resilient peripheral portion 46 of the roller 49 applies a film of properly processed (crushed and/or distributed) printing ink to the stamps 51 for the application of printed matter to selected portions of one side of the running cigarette paper web 21.

The roller 47 is or can be identical with the roller 49, not only as concerns its construction but also regarding its function in the improved imprinting apparatus 23. Therefore, FIG. 3 merely shows the details of one presently preferred embodiment of the roller 47.

The resilient peripheral portion 46 of the roller 47 is a hollow cylinder having two sleeve-like sections which surround and are affixed to the peripheral surface of a cylindrical sleeve 54; the latter is non-rotatably but (axially) removably mounted on a bearing sleeve 58 constituting the outer race of an antifriction bearing including two annuli of spherical rolling elements 59. The means for non-rotatably but removably affixing the sleeve 54 to the outer race 58 of the antifriction bearing includes threaded fasteners 56 which are accessible at one axial end of the sleeve 54 and maintain the other axial end of this sleeve in contact with an annular stop 57 here shown as a nut meshing with the outer race 58.

The common axis of the outer race 58 and of the roller 47 is shown at 61; this outer race is free to rotate about the axis 61 (together with the sleeve 54 and the two-piece hollow cylindrical resilient peripheral portion 46 of the roller 47. The end portions of the outer race 58 contain labyrinth seals 62 which sealingly engage an inner race 63 constituting a sleeve-like eccentric. The adjusting means including the eccentric 63 can be actuated to select the force with which the exposed surface of the peripheral portion 46 of the roller 47 bears upon the peripheral surfaces of the rollers 43 and 44. To this end, the axis 64 of the eccentric 63 is parallel with the axis 61 of the outer race 58 and the eccentric 63 constitutes the outer race of a second antifriction bearing including two annuli of spherical rolling elements 65.

The eccentric 63 receives torque from a coil spring 64 by way of a ring 66 which is affixed to one axial end of the eccentric by axially parallel threaded or other suitable fasteners 69. The coil spring reacts against the wall 67 of a fixed housing and tends to turn the eccentric 63 by way of the ring 66 and fasteners 69.

The exact magnitude of the force with which the resilient peripheral portion 46 of the roller 47 bears upon the external surfaces of the rollers 43 and 44 can be selected by a releasable or disengageable rotation preventing device 71 which can be deactivated to permit angular adjustments of the wall 67 and hence an adjustment of the bias of the prestressed coil spring 68 upon the eccentric 63.

The two annuli of spherical antifriction rolling elements 65 in the interior of the eccentric 63 are disposed at opposite axial ends of a hollow distancing sleeve or retainer 72. The right-hand end face of the retainer 72 is separated from the respective rolling elements 65 by a diaphragm spring 73 which biases the cylindrical retainer 72 (and hence also the peripheral portion 46) axially in a direction to the left, as viewed in FIG. 3. Such axial stressing of the peripheral portion 46 is desirable and advantageous because the halves of this peripheral portion compensate for (absorb) undesirable axial oscillatory movements of certain rollers in the imprinting apparatus 23. Such undesirable (stray) movements could affect the quality of the prints which are being applied to the running web 21 by the stamps 51 of the roller 48.

In addition, the ability of the improved rollers 47, 49 to select the bias of their respective resilient peripheral portions 46 upon the adjacent roller or rollers of the imprinting apparatus 23 renders it possible to regulate certain other important parameters such as the consistency of printing ink which is being applied to the faces of the stamps 51, changes of temperature (and hence changes in the dimensions of affected parts), changes in the speed of rotary movement of the rollers and/or others. Changes of temperature can entail rather pronounced expansion or contraction of affected parts of the apparatus 23 and, in the absence of at least some compensation, this could affect the quality of the applied printed matter.

It has been found that the adjustable rollers 47 and 49 enable the apparatus 23 to apply high-quality imprints for long periods of time in spite of unanticipated changes of parameters which could affect the quality of (such as blur) the applied printed information which, as already mentioned above, can include and often or invariably includes the trademark(s) and/or the name of the manufacturer of plain or filter cigarettes, cigars, cigarillos and/or other rod-shaped products of the tobacco processing industry or other industries.

The improved imprinting apparatus is susceptible of numerous additional modifications without departing from the spirit of the invention. For example, only one of the rollers in the roller train can be provided with a resilient cylindrical peripheral portion 46 or the number of such rollers can exceed two. Furthermore, the number of rollers in the roller train can be less or greater than the number shown in FIG. 2, and the source of printing ink can include two or more nozzles 53 or other suitable ink supplying devices. Still further, the means for biasing the resilient peripheral portion 46 of one of the rollers 47, 49 need not be identical with the biasing means for the peripheral portion of the other of such adjustable rollers, i.e., the biasing means including the eccentric 63 and the prestressed torsion spring 68 shown in FIG. 3 constitute but one of a variety of biasing means which can be put to use in the improved imprinting apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of apparatus for applying printed matter to running webs of paper or the like and, therefore, such adaptations should and are intended to be comprehended within the meaning and range of equivalence of the appended claims.

What is claimed is:

1. Apparatus for applying printed matter to a running web of paper, comprising:

a source of printing ink;

a mobile web-contacting imprinting member;

a roller train arranged to convey printing ink from said source to said imprinting member and including a plurality of rollers, at least one of said rollers having a resilient peripheral portion contacting at least one other roller of said roller train; and means for biasing said resilient peripheral portion against said at least one other roller, said biasing means including means for urging said resilient peripheral portion against said at least one other roller with a variable force, and said means for urging including at least one prestressed resilient element and an eccentric interposed between said at least one resilient element and said resilient peripheral portion of said at least one roller.

2. The apparatus of claim 1, further comprising means for rotating one of said at least one roller and said at least one other roller, said resilient peripheral portion being in frictional engagement with said at least one other roller to thus transmit torque between said at least one roller and said at least one other roller.

3. The apparatus of claim 1, wherein said at least one roller is rotatable about a first axis and said eccentric is turnable about a fixed second axis at least substantially parallel to said first axis to thus move said resilient peripheral portion of said at least one roller sideways in a direction at least substantially radially of said at least one other roller, said resilient element being arranged to bias said resilient peripheral portion in said direction.

4. The apparatus of claim 3, wherein said eccentric is at least partially confined within said at least one roller.

5. The apparatus of claim 4, wherein said eccentric is a hollow cylinder.

6. The apparatus of claim 3, wherein said resilient element comprises a coil spring having a first portion reacting against a stationary member and a second portion at least indirectly bearing upon and tending to turn said eccentric about said second axis.

7. The apparatus of claim 6, wherein said stationary member includes a wall and further comprising a ring coaxial with and affixed to said eccentric and being acted upon by said second portion of said coil spring.

8. The apparatus of claim 6, further comprising disengageable rotation preventing means for said stationary member.

9. The apparatus of claim 3, wherein said eccentric is oscillatable in the direction of said second axis, and further comprising means for yieldably opposing oscillation of said eccentric.

10. The apparatus of claim 9, wherein said means for opposing comprises a diaphragm spring reacting against a retainer and bearing upon an end face of said eccentric.

11. The apparatus of claim 1, wherein said source includes at least one nozzle arranged to discharge ink into a nip of two rollers of said roller train.

12. The apparatus of claim 1, wherein said imprinting member includes a further roller rotatable about a predetermined axis and having a peripheral surface provided with at least one stamp which contacts the web once during each revolution of said further roller about said predetermined axis.

13. Apparatus for applying printed matter to a running web of paper, comprising:

a source of printing ink;

a mobile web-contacting imprinting member;

a roller train arranged to convey printing ink from said source to said imprinting member and including a plurality of rollers, at least one of said rollers having a resilient peripheral portion contacting at least one other roller of said roller train, wherein said roller train includes said at least one roller, said at least one other roller and a third roller, said resilient peripheral portion contacting said at least one other roller and said third roller; and means for biasing said resilient peripheral portion against said at least one other roller, wherein said biasing means including means for urging said resilient peripheral portion against said at least one other roller with a variable force.

14. Apparatus for applying printed matter to a running web of paper, comprising:

a source of printing ink;

a mobile web-contacting imprinting member;

a roller train arranged to convey printing ink from said source to said imprinting member and including a plurality of rollers, at least one of said rollers having a resilient peripheral portion contacting at least one other roller of said roller train, said at least one other roller being rotatable about a predetermined axis and oscillatable in the direction of said axis; and means for biasing said resilient peripheral portion against said at least one other roller, said biasing means including means for urging said resilient peripheral portion against said at least one other roller with a variable force.

15. Apparatus for applying printed matter to a running web of paper, comprising:

a source of printing ink;

a mobile web-contacting imprinting member;

a roller train arranged to convey printing ink from said source to said imprinting member and including a plurality of rollers, at least one of said rollers having a resilient peripheral portion contacting at least one other roller of said roller train, wherein said roller train includes four rollers rotatable about at least substantially parallel axes and including a driven first roller, a second roller driven by said first roller, a third roller driven by said second roller, and a fourth roller driven by said third roller, said at least one roller constituting one of said second and fourth rollers and said at least one other roller constituting one of said first and third rollers; and means for biasing said resilient peripheral portion against said at least one other roller.

16. Apparatus for applying printed matter to a running web of paper, comprising:

a source of printing ink;

a mobile web-contacting imprinting member;

a roller train arranged to convey printing ink from said source to said imprinting member and including a plurality of rollers, at least one of said rollers having a resilient peripheral portion contacting at least one other roller of said roller train, wherein said resilient peripheral portion of said at least one roller is arranged to contact said imprinting member; and means for biasing said resilient peripheral portion against said at least one other roller.

17. Apparatus for applying printed matter to a running web of paper, comprising:

a source of printing ink;

a mobile web-contacting imprinting member;

a roller train being installed at a wrapping mechanism in a cigarette making machine and arranged to convey printing ink from said source to said imprinting member and including a plurality of rollers, at least one of said rollers having a resilient peripheral portion contacting at least one other roller of said roller train; and means for biasing said resilient peripheral portion against said at least one other roller.

18. Apparatus for applying printed matter to a running web of a strip of cigarette paper, comprising:

a source of printing ink;

a mobile web-contacting imprinting member;

a roller train arranged to convey printing ink from said source to said imprinting member and including a plurality of rollers, at least one of said rollers having a resilient peripheral portion contacting at least one other roller of said roller train; and means for biasing said resilient peripheral portion against said at least one other roller.

* * * * *